US010751746B2

(12) United States Patent
Blessing et al.

(10) Patent No.: US 10,751,746 B2
(45) Date of Patent: Aug. 25, 2020

(54) SWIVEL SHOWER HAVING A FLUID PRESSURE DRIVEN SWIVEL BODY

(71) Applicant: Hansgrohe SE, Schiltach (DE)

(72) Inventors: Gerd Blessing, Villingen-Schwenningen-Obereschach (DE); Daniel Philipp Dieterle, Wolfach-Kimbach (DE)

(73) Assignee: Hansgrohe SE, Schiltach (DE)

( * ) Notice: Subject to any disclaimer, the term of this patent is extended or adjusted under 35 U.S.C. 154(b) by 149 days.

(21) Appl. No.: 15/916,233

(22) Filed: Mar. 8, 2018

(65) Prior Publication Data

US 2018/0257097 A1 Sep. 13, 2018

(30) Foreign Application Priority Data

Mar. 9, 2017 (DE) ..... 10 2017 203 945

(51) Int. Cl.
*B05B 15/74* (2018.01)
*B05B 15/652* (2018.01)
(Continued)

(52) U.S. Cl.
CPC ..... *B05B 15/74* (2018.02); *B05B 1/18* (2013.01); *B05B 1/185* (2013.01); *B05B 1/3006* (2013.01);
(Continued)

(58) Field of Classification Search
CPC ..... B05B 3/0422; B05B 3/044; B05B 1/3006; B05B 1/302; B05B 1/3026; B05B 15/74;
(Continued)

(56) References Cited

U.S. PATENT DOCUMENTS 5,159,722 A 11/1992 Diethelm
6,343,389 B1 2/2002 Jones
(Continued)

FOREIGN PATENT DOCUMENTS

DE 4130892 A1 3/1992
DE 19945854 A1 3/2001
(Continued)

OTHER PUBLICATIONS

Russian language with English translation of Decision on Granting issued by The Federal Service for Intellectual Property, Patents and Trademarks (ROSPATENT) for Russian Application No. 2018107966/05(012340), dated Jan. 23, 2019.
(Continued)

*Primary Examiner* — Steven J Ganey
(74) *Attorney, Agent, or Firm* — Faegre Drinker Biddle & Reath LLP

(57) ABSTRACT

Swivel shower including a base body, a swivel body including a shower outlet and held on the base body for swivel movement about a swivel axis between a first swivel body end position, constituting a rest position, and a second swivel body end position, constituting an operating position, a shower fluid inlet for supplying a shower fluid, and a swivel drive for driven swiveling of the swivel body, wherein the swivel drive includes a slide piston capable of being pressurized by a fluid pressure of the supplied shower fluid, which piston is arranged for translational movement between a first piston end position, corresponding with the first swivel body end position, and a second piston end position, corresponding with the second swivel body end position. Illustratively, the slide piston is arranged with a translation directional component in parallel to the swivel axis, and/or the swivel drive includes a transmission element in the form of a slotted guide mechanism between the slide
(Continued)

piston and the swivel body, wherein the transmission element transmits the translational movement of the slide piston into a swivel movement of the swivel body, and/or the shower outlet in the rest position of the swivel body is swiveled away from a visible face of the swivel shower, and a swivel angle stroke from the first to the second swivel body end position is at most 90°.

20 Claims, 5 Drawing Sheets

(51) Int. Cl.

| | |
|---|---|
| ***B05B 1/18*** | (2006.01) |
| ***B05B 1/30*** | (2006.01) |
| ***B05B 15/70*** | (2018.01) |
| ***B05B 15/72*** | (2018.01) |
| ***B05B 3/04*** | (2006.01) |
| ***E03C 1/04*** | (2006.01) |

(52) U.S. Cl.
CPC ..... *B05B 1/3026* (2013.01); *B05B 3/044* (2013.01); *B05B 3/0422* (2013.01); *B05B 15/652* (2018.02); *B05B 15/70* (2018.02); *B05B 15/72* (2018.02); *E03C 1/0408* (2013.01); *B05B 1/302* (2013.01)

(58) Field of Classification Search
CPC ..... B05B 15/70; B05B 15/72; B05B 1/185; B05B 15/652; B05B 1/18; E03C 1/0408
USPC ..... 239/237, 242, 203–205, 533.1, 533.15, 239/537, 538, 452, 587.1, 587.5, 587.6
See application file for complete search history.

(56) References Cited

U.S. PATENT DOCUMENTS

| | | | | |
|---|---|---|---|---|
| 7,770,825 | B2 * | 8/2010 | Kajuch | B05B 1/18 239/587.1 |
| 8,122,528 | B2 | 2/2012 | Heisterhagen | |
| 8,196,234 | B2 | 6/2012 | Glunk | |
| 8,714,463 | B2 * | 5/2014 | Bischoff | A61H 33/6063 239/538 |
| 2008/0168600 | A1 | 7/2008 | Gross et al. | |
| 2008/0168601 | A1 | 7/2008 | Glunk | |

FOREIGN PATENT DOCUMENTS

| | | | |
|---|---|---|---|
| EP | 1 947 251 | B1 | 7/2008 |
| EP | 1947252 | A2 | 7/2008 |
| EP | 1947251 | B1 | 4/2014 |
| RU | 79902 | U1 | 1/2009 |
| RU | 2376423 | C2 | 12/2009 |

OTHER PUBLICATIONS

European Search Report issued by the European Patent Office, dated Jul. 4, 2018, for related Application No. EP18159761; 6 pages.

* cited by examiner

SWIVEL SHOWER HAVING A FLUID PRESSURE DRIVEN SWIVEL BODY

CROSS-REFERENCE TO RELATED APPLICATION

This application claims priority to German Patent Application DE 10 2017 203 945.0, filed on Mar. 9, 2017, the disclosure of which is expressly incorporated by reference herein.

BACKGROUND AND SUMMARY OF THE DISCLOSURE

The invention relates to a swivel shower comprising a base body, a swivel body including a shower outlet and held on the base body for swivel movement about a swivel axis between a first swivel body end position, constituting a rest position, and a second swivel body end position constituting an operating position, a shower fluid inlet for supplying a shower fluid, and a swivel drive for driven swivelling of the swivel body, wherein the swivel drive includes a slide piston capable of being pressurized by a fluid pressure of the supplied shower fluid, which piston is arranged for translational movement between a first piston end position, corresponding with the first swivel body end position, and a second piston end position, corresponding with the second swivel body end position.

Swivel showers of this type are useable, for example, as wall- or ceiling-mounted sanitary swivel showers, such as ceiling-mounted over-head showers which can be swivelled, and as wall-mounted side showers which can be swivelled, in shower rooms.

Said swivel showers have a swivel body which is held on a base body for swivel movement and has a shower outlet, wherein the swivel body can be swivelled between two end positions, of which one acts as a rest position and the other as an operating position. In the rest position, the swivel shower is inactive, i.e. shower fluid does not emerge from the shower outlet. In the operating position, the swivel body is in its active shower position, in which the shower fluid which is supplied via a shower fluid inlet leaves the shower outlet as a corresponding shower jet.

For driven swivelling of the swivel body, use is made of a swivel drive which includes a slide piston capable of being pressurized by a fluid pressure of the shower fluid, which piston is arranged for translational movement between a first piston end position and a second piston end position, corresponding with the two swivel body end positions. The shower fluid inlet can be located, for example, on the base body or on the swivel body.

A swivel shower of the type mentioned at the beginning is disclosed in patent EP 1 947 251 B1. The swivel shower there is designed as a sanitary shower spray device for wall and/or ceiling mounting, with a flat outer surface. The flat outer side of the swivel shower here forms the visible face of the shower, i.e. that face which is visible to or faces the user in the mounted state of the swivel shower. The swivel body is formed by a shower carrier which carries one or more shower units. In the active operating position, the shower units protrude over the outer side of the shower. Tubular sections of a shower fluid supply serve as swivel axes of the shower carrier, and the slide piston of the swivel drive, said slide piston being capable of being pressurized by the fluid pressure of the supplied shower fluid, is arranged with a translation direction perpendicular to the swivel axes. In an embodiment which is shown, said slide piston presses with a pressure pin at a lateral distance from the swivel axes against an inner side of the shower carrier and swivels the latter by approx. 15° from a rest position, in which its shower outlet side runs parallel to the flat outer side of the swivel shower, into an oblique operating position in comparison thereto. Alternatively, the use of a step-up with deflection is proposed in order to be able to swivel the shower carrier even by 180°, when required, and therefore, in the rest position, a smooth side faces outwards and the visible face of the swivel shower accordingly acts in a closed manner.

It is an object of the invention to provide a swivel shower of the type mentioned at the outset with functionalities or properties which are improved in relation to the abovementioned prior art.

The invention achieves this and other objects by providing a novel and inventive swivel shower having the features mentioned at the outset and one or more additional features.

According to a first aspect of the invention, the slide piston of the swivel drive for the swivel body is arranged with a translation directional component in parallel to the swivel axis. This means that the translation direction of the slide piston is parallel to the swivel axis or at any rate has a component, which is different from zero, parallel to the swivel axis, i.e. the translation direction of the slide piston is not perpendicular to the swivel axis. This arrangement of the slide piston can form functional advantages for the swivel drive and can promote a compact constructional form of the swivel shower.

According to a further aspect of the invention, the swivel drive includes a transmission element in the form of a slotted guide mechanism between the slide piston and the swivel body in order to transmit the translational movement of the slide piston into a swivel movement of the swivel body. A transmission element of this type can afford functional advantages and permits a favourable conversion of the linear translational movement of the slide piston into the rotational movement carried out by the swivel body during swivelling.

According to a further aspect of the invention, the shower outlet in the rest position of the swivel body is swivelled away from a visible face of the swivel shower, and a swivel angle stroke from the first to the second swivel body end position is at most 90°. As already explained above, the visible face here means that side of the swivel shower which is visible to the user in the mounted state of the swivel shower or faces the user during use as intended. In the case of a wall- or ceiling-mounted sanitary shower, the visible face is typically a shower front side which faces the user located in front of or under the swivel shower. This measure can afford functional and design advantages. In this inactive position of the swivel body, the shower outlet can thus be swivelled away invisibly to the user, i.e. by being swivelled into the base body. Nevertheless, a swivel angle stroke of at most 90° is sufficient in order to swivel the swivel body into its active-shower operating position in which the swivel shower outputs the desired shower jet via its shower outlet, for which purpose the shower outlet is typically located visibly to the user on the visible face of the swivel shower. Depending on requirements and the use situation, the swivel angle stroke of the swivel body is also only at most 50°, for example approx. 45° or less. As is clear to a person skilled in the art, the above aspects of the invention are not necessarily functionally related and can therefore be realized in each case individually or jointly or in any desired combination in corresponding embodiments.

In a development of the invention, the slotted guide mechanism comprises a first guiding part including a sliding track and a second guiding part having a sliding cam cooperating with the sliding track. Of said two guiding parts, the one guiding part is arranged unmoved on the base body, while the other guiding part is arranged for translational movement together with the translational movement of the slide piston and coupled for rotary movement to the swivel body. Said slotted guide mechanism permits a functionally reliable and stable transmission of the translational movement of the slide piston into the rotary or swivelling movement of the swivel body, and the swivel shower can be constructed relatively compactly when required.

In a refinement of the invention, that guiding part which is arranged for translational movement together with the translational movement of the slide piston and coupled for rotary movement to the swivel body includes a follower sleeve cooperating with an end face of the slide piston. Said follower sleeve can be moved in a translatory manner by the slide piston and can simultaneously be rotated via the slotted guide mechanism, as a result of which the swivel body coupled for rotary movement to the latter is swivelled.

In a development of the invention, the slide piston is guided for translational movement on a swivel shaft sleeve defining the swivel axis. The swivel shaft sleeve can thereby provide both a swivel shaft for swivelling the swivel body and a guide for the slide piston which is moved in a translatory manner. Additionally or alternatively, the slide piston is telescopically shiftable onto or into the swivel shaft sleeve.

In a development of the invention, the swivel shower has an elastic piston return element preloading the slide piston to its first piston end position. The elastic piston return element can be, for example, a compression or tension spring which is supported on the base body on the one hand and on the slide piston on the other hand or is connected to same at one spring end in each case. In corresponding embodiments, the tension/compression spring can be shifted coaxially onto the swivel shaft sleeve and thereby held or guided thereon. By preloading the slide piston to its first piston end position, the swivel body is accordingly preloaded into its rest position. If no shower fluid is supplied or the shower fluid supply is shut off or blocked, the swivel body, in corresponding embodiments of the invention, takes up said rest position which is stabilized by the action of the elastic piston return element. When the shower fluid supply is opened, the fluid pressure of the supplied shower fluid then presses the slide piston counter to the action of the elastic piston return element in the direction of its second piston end position, as a result of which the swivel body is swivelled into its active operating position.

In a development of the invention, the swivel body is a cuboid-shaped shower cartridge including the shower outlet on one of its cuboid sides and a cover surface on an adjacent cuboid side, which cover surface is parallel to the visible face of the swivel shower in the first swivel body end position. Such a swivel body can be produced with a relatively small outlay and may be of advantage in terms of design and functionality. In the active rest position of the swivel body, its cover surface thereof can be seen on the visible face of the swivel shower, while the shower outlet can be concealed so as not to be visible to the user. If desired, the cover surface here can form, for example, a substantially flush end with an adjacent surface of the swivel shower or of the base body thereof, and/or the cover surface can have a surface composition which is substantially uniform with an adjacent surface of the swivel shower, and therefore the swivel body joins harmoniously into an inconspicuous overall image of the swivel shower on the visible face thereof in said rest position. Only if the cuboid-shaped shower cartridge forming the swivel body is swivelled into its active operating position does its cuboid side containing the shower outlet appear on the visible face of the swivel shower, and the desired shower jet is then output via the shower outlet.

In a development of the invention, the swivel shower has a locking element by means of which the swivel body is lockable in the second swivel body end position. As a result, the swivel body can be held in its second swivel body end position, for example for maintenance or cleaning work, irrespective of whether fluid pressure is present because of supplied shower fluid, or the shower fluid supply is blocked. This is useful particularly for embodiments of the swivel shower in which the swivel body in the rest position is swivelled away from the visible face of the swivel shower or is not freely accessible from the outside for the user.

In a development of the invention, the shower outlet includes a jet outlet plate having at least one jet outlet nozzle, the nozzle longitudinal axis of which encloses an acute angle, i.e. an angle of greater than 0° and less than 90°, with the jet outlet plate. The nozzle longitudinal axis here defines, as customary, a main jet direction of a shower jet emerging from the shower outlet nozzle or of a shower jet formed by a plurality of such jet outlet nozzles. This means that, in this case, the shower jet emerges at an acute angle of its main jet direction to the jet outlet plate. As a result, for example, the shower jet can be output with its main jet direction perpendicular to a visible face of the swivel shower if or although the jet outlet plate is not oriented parallel, but rather obliquely with respect to the visible face of the swivel shower in the active operating position of the swivel body.

In a development of the invention, the swivel shower includes a shut-off valve arranged in a fluid flow path between the shower fluid inlet and the shower outlet, said valve blocking and unblocking the fluid flow path as a function of a swivel position of the swivel body. Said shut-off valve thus completely blocks the fluid flow path in the first swivel body end position and completely unblocks same in the second swivel body end position. This has the advantage that no shower fluid can emerge from the shower outlet when the swivel body is in the inactive rest position. On the other hand, the shut-off valve completely unblocks the shower fluid for the active shower operation when the swivel body is in the operating position. The blocking and unblocking functionality of the shut-off valve is advantageously controlled by the swivel position of the swivel body, which automatically ensures that the shut-off valve provides the desired valve function in the respective swivel body end position.

In a refinement of the invention, the shut-off valve has a switching hysteresis, according to which the valve starts unblocking the fluid flow path during swivelling of the swivel body from the first swivel body end position in the direction towards the second swivel body end position with a delay as compared to it completely blocking the fluid flow path during swivelling of the swivel body from the second swivel body end position in the direction towards the first swivel body end position. In other words, during swivelling of the swivel body from the rest position, shower fluid begins to emerge from the shower outlet only from a predetermined unblocking swivel angle since the shower fluid supply remains blocked by the shut-off valve up to then. If the swivel body is swivelled back from its operating position into its rest position after the active shower operation, the shut-off valve completely blocks the shower fluid supply to the shower outlet only at a shut-off swivelling angle which lies closer to the first swivel body end position than the unblocking swivel angle. Shower fluid can therefore still emerge from the shower outlet for a somewhat longer period before the shut-off valve completely blocks the shower fluid supply to the shower outlet and the swivel body reaches its rest position. This can be advantageous for corresponding use situations.

BRIEF DESCRIPTION OF THE DRAWINGS

Advantageous embodiments of the invention are illustrated in the drawings and are described below. In the drawings.

DETAILED DESCRIPTION OF THE DRAWINGS

Figure 1:
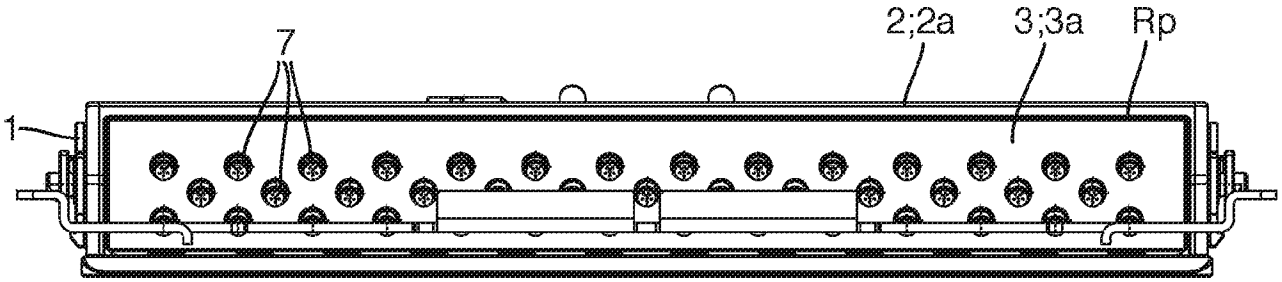
FIG. 1 shows a side view of a swivel shower onto a shower outlet side of a swivel body in a swivelled-in rest position.
Figure 2:
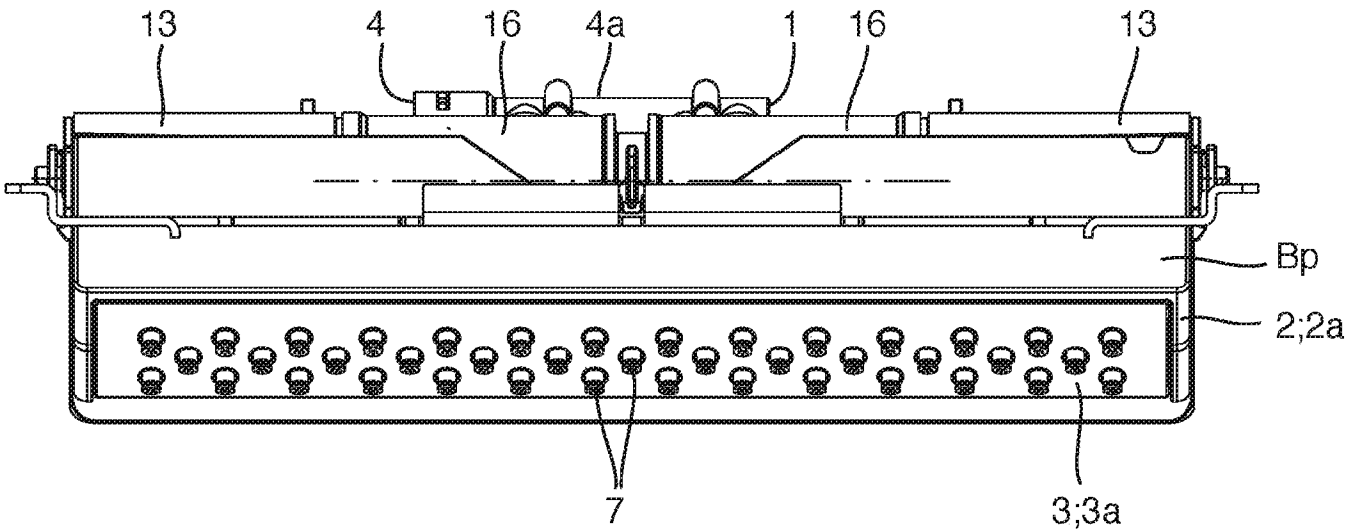
FIG. 2 shows the view from FIG. 1, with the swivel body swivelled out into the operating position.

The swivel shower shown in FIGS. 1 to 8 is suitable, for example, as a sanitary swivel over-head shower for mounting on the ceiling or as a sanitary swivel side shower for mounting on the wall in shower rooms. It comprises a base body 1 and a swivel body 2 including a shower outlet 3. The swivel body 2 is held on the base body 1 for swivel movement about a swivel axis Sa between a first swivel body end position Rp, constituting an inactive-shower rest position, and a second swivel body end position Bp, constituting an active-shower operating position. A shower fluid inlet 4 serves for supplying a shower fluid, such as, for example, showering water. In the exemplary embodiment shown, the shower fluid inlet 4 is formed by a fluid-inlet-side tubular connection piece 4*a*, which is formed on the base body 1 or is connected thereto. In alternative embodiments, the shower fluid inlet 4 is realized in another customary manner and/or is formed on the swivel body 2 or is connected thereto.

A swivel drive 5 serves for the driven swivelling of the swivel body 2, wherein the swivel drive 5 includes a slide piston 5*a* capable of being pressurized by a fluid pressure of the supplied shower fluid. The slide piston 5*a* is arranged for translational movement between a first piston end position K1, corresponding with the first swivel body end position Rp, and a second piston end position K2, corresponding with the second swivel body end position Bp. The translational movement of the slide piston 5*a*, i.e. the linear displacement movement thereof, takes place in a translation direction TR which has a parallel translation directional component TRp different from zero. As is customary for slide pistons, the slide piston translation direction TR is parallel to an axial direction or longitudinal axis SL of the slide piston 5*a*. In the example shown, the slide piston translation direction TR is parallel to the swivel axis Sa. In alternative embodiments, apart from the directional component TRp in parallel to the swivel axis Sa, the translation direction TR of the slide piston 5*a* additionally has a translation directional component which is different from zero and is perpendicular to the swivel axis Sa, i.e., in this case, the displacement direction TR of the slide piston 5*a* is oriented obliquely with respect to the swivel axis Sa of the swivel body 2.

Figure 3:
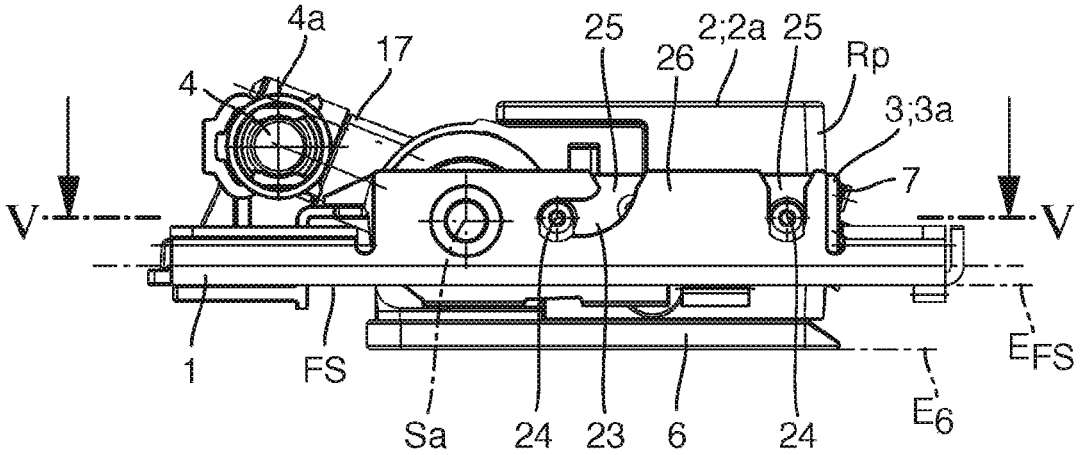
FIG. 3 shows a side view of the swivel shower onto a transverse side with the swivel body in the rest position.
Figure 4:
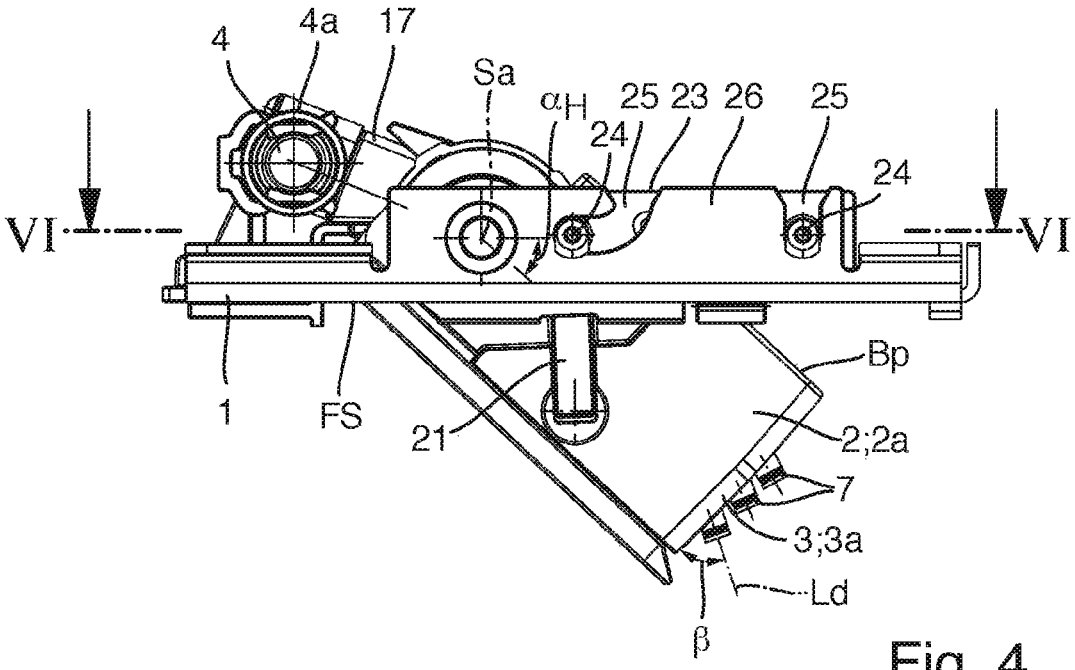
FIG. 4 shows the view of the FIG. 3 with the swivel body swivelled out into the operating position.
Figure 5:
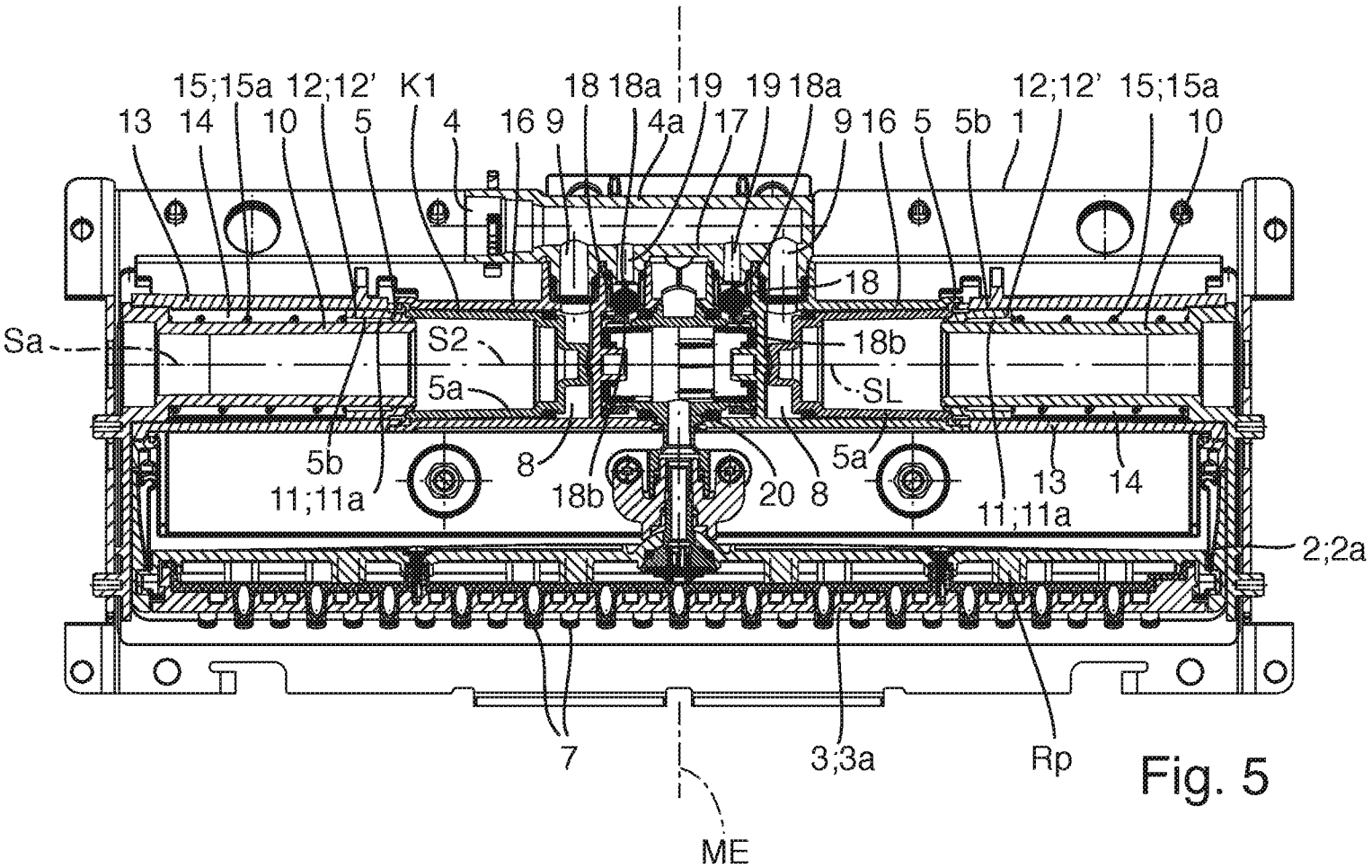
FIG. 5 shows a sectional view of the swivel shower along a line V-V of FIG. 3.
Figure 6:
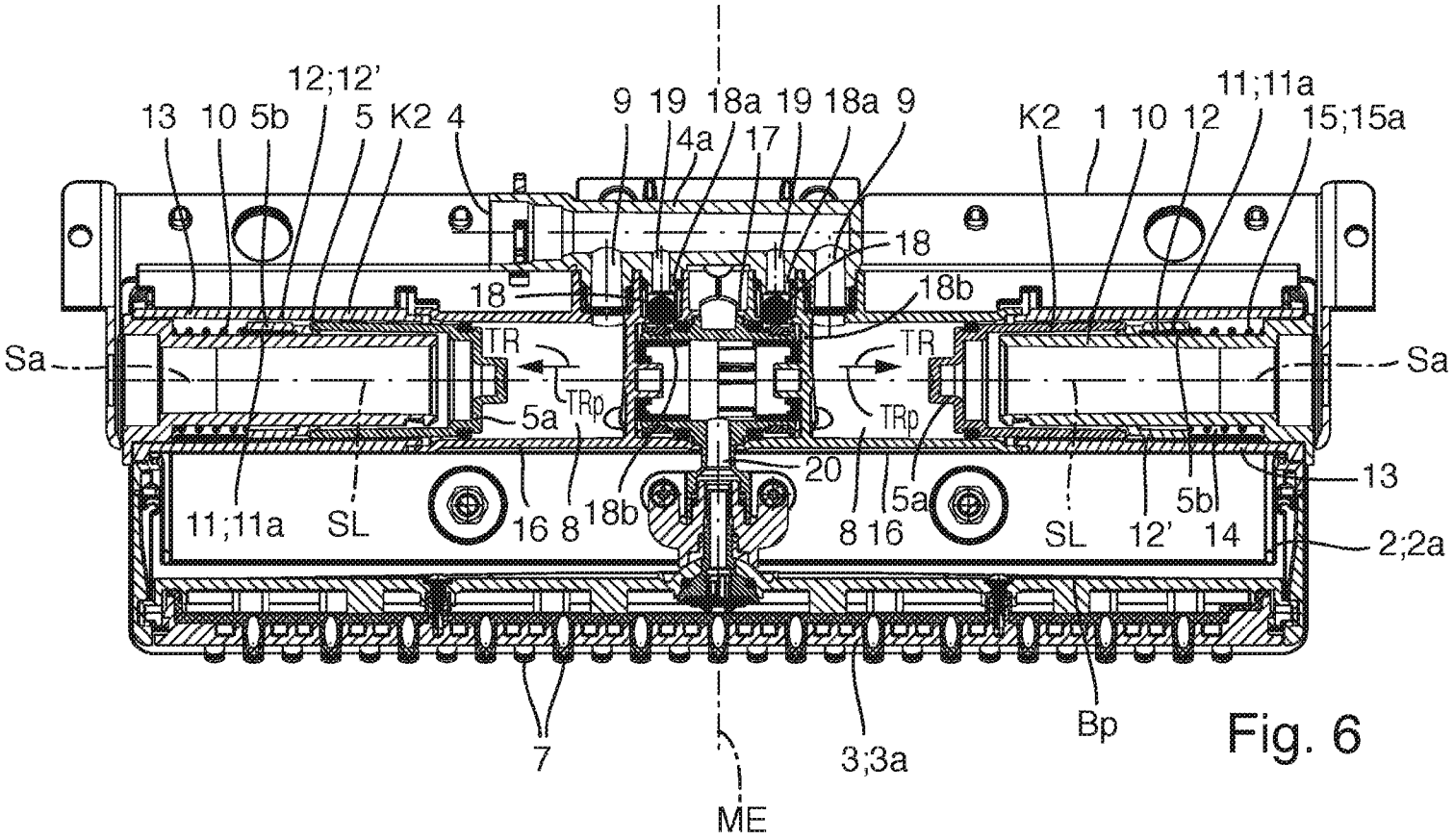
FIG. 6 shows a sectional view of the swivel shower along a line VI-VI of FIG. 4.
Figure 7:
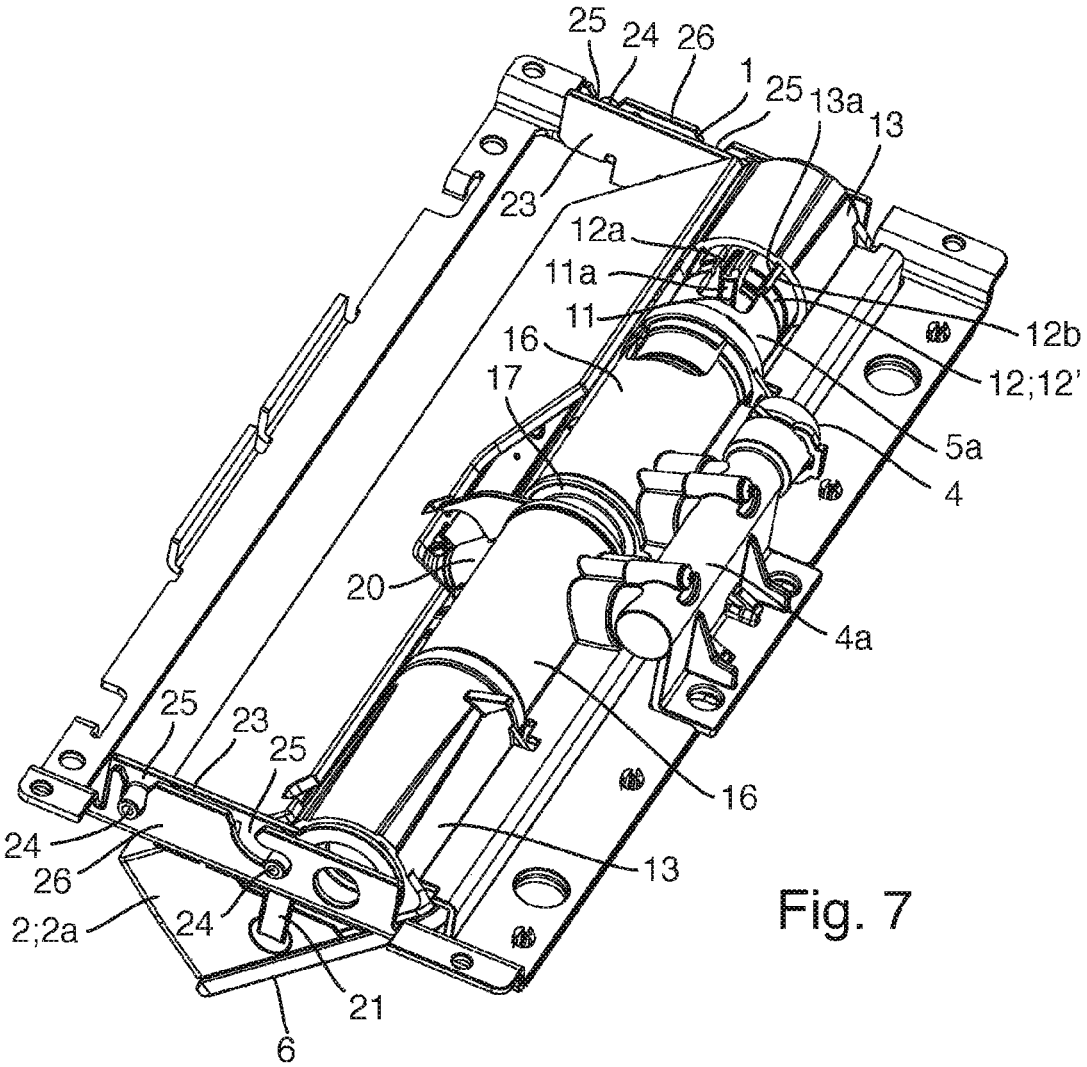
FIG. 7 shows a partially sectioned perspective view of the swivel shower with the swivel body swivelled out into the operating position.
Figure 8:
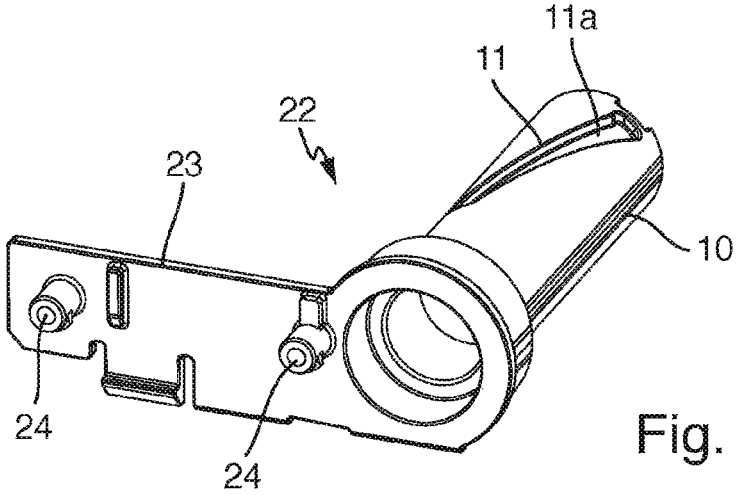
FIG. 8 shows a perspective view of a swivel axis component of the swivel shower of FIGS. 1 to 7.

In the example shown, a side of the swivel shower that is at the bottom in FIGS. 3 and 4 forms a front side or visible face FS, which, as already stated, should be understood as meaning that side of the swivel shower which should be understood as meaning the side facing the user in the mounted state of the swivel shower, i.e. after mounting on a ceiling or wall region of a shower room, or side which is visible to said user. As is furthermore apparent, for example, from FIGS. 3 and 4, the shower outlet 3 in the rest position Rp of the swivel body 2 is swivelled away from the visible face FS of the swivel shower. In order to move the swivel body 2 from its rest position Rp, as the first swivel body end position, into the active-shower operating position Bp, as the second swivel body end position, said swivel body needs to be pivoted by at most 90°. In the exemplary embodiment shown, the swivel angle stroke, i.e. a swivel angle $\alpha_H$ between the two swivel body end positions Rp, Bp, is approx. 45°. In alternative embodiments, said swivel angle stroke $\alpha_H$ can have any desired other value, preferably within the range of between 0° and 90°.

In the exemplary embodiment shown, the swivel body 2 is formed by a cuboid-shaped shower cartridge 2*a* including the shower outlet 3 on one of its cuboid sides and a cover surface 6 on an adjacent cuboid side. The cover surface 6 is parallel to the visible face FS of the swivel shower in the first swivel body end position Rp, i.e. a plane $E_6$ of the cover surface 6 is parallel to a plane $E_{FS}$ of the visible face FS. As a result, only said cover surface 6 of the swivel body 2 is visually apparent to the user when the swivel shower is not in the active shower operation and therefore the swivel body 2 takes up its rest position Rp. In this case, the shower outlet 3 is swivelled into the frame-shaped base body 1 so as to be invisible to the user. Depending on desire or requirements, the swivel shower with said cover surface 6 can end substantially flush with an adjacent surface of the swivel shower and/or with an adjacent ceiling or wall region of a shower room. Additionally or alternatively, the cover surface can have a surface composition which is substantially uniform with an adjacent surface region of the swivel shower and/or with a ceiling or wall of a shower room, and therefore the swivel body 2 in its rest position Rp fits harmoniously and inconspicuously into the overall image of the swivel shower on its visible face FS.

In alternative embodiments, the swivel body 2 has a shape deviating from a cuboid shape, for example a triangular shape or semi-circular shape in cross section. Furthermore, the invention comprises embodiments in which the swivel body 2 is cuboid-shaped, but does not have a cover surface in the manner of the cover surface 6. In addition, in corresponding alternative embodiments of the invention, that side of the swivel body 2 which has the shower outlet 3 can lie entirely or partially on the visible face FS of the swivel shower when the swivel body 2 is in its inactive rest position Rp.

In the exemplary embodiment shown, the shower outlet 3 has a jet outlet plate 3*a* having at least one jet outlet nozzle 7, the nozzle longitudinal axis Ld of which encloses an acute angle β with the jet outlet plate 3*a*. The jet outlet plate 3*a* preferably includes, as shown, a plurality of such jet outlet nozzles 7 with mutually parallel nozzle longitudinal axes Ld. The jet outlet nozzles 7 can be of any conventional type, for example they can be formed by outlet nipples which extend through associated openings in the jet outlet plate 3*a*, which functions as what is referred to as a jet disc, and are preferably composed of an elastomeric material, or can be formed simply by outlet nozzle openings introduced into the jet outlet plate 3*a*. In the active shower operation, the jet outlet nozzles 7 produce a shower jet with a main jet direction parallel to the nozzle longitudinal axes Ld, i.e. the shower fluid leaves the shower with said preferred direction which is parallel to the nozzle longitudinal axes Ld and can also be understood as a longitudinal axis of the shower jet.

In the exemplary embodiment shown, the oblique inclination of the nozzle longitudinal axes Ld in relation to the jet outlet plate 3*a* by the angle β can cause a shower jet to be output from the shower outlet 3, the main jet direction of which shower jet runs perpendicularly or approximately perpendicularly to the visible face FS of the shower although the jet outlet plate 3*a* is oriented perpendicularly to the visible face FS of the shower in the swivelled-in rest position Rp and the shower cartridge 2*a* is swivelled out into the active operating position Bp only by, for example, 45° to 50°. The angular position of the main jet direction of the shower jet relative to the visible face FS of the shower arises from adding the swivel angle stroke $\alpha_H$ and the oblique angle 90°-β of the nozzle longitudinal axis Ld with respect to a plane perpendicular of the jet outlet plate 3*a* and can therefore be set to any desired value by suitable selection of the angles $\alpha_H$ and β, for example within the range of 70° to 90°.

For the pressurization of the slide piston 5*a* by fluid pressure, the swivel shower has a piston chamber 8 which is fluidically connected to the shower fluid inlet 4 and is connected via a connecting passage 9 to the fluid-inlet-side tubular connection piece 4*a*. In the example shown, the slide piston 5*a* is designed as a hollow-cylindrical component with an end face closed towards the piston chamber 8 and with an oppositely open end face.

The slide piston 5*a* is shiftable with its open end face onto a swivel shaft sleeve 10, wherein said slide piston coaxially surrounds the latter. The swivel shaft sleeve 10 is formed on the base body 1 or is attached to the latter and, with its longitudinal centre axis, defines the swivel axis Sa of the swivel body 2 which is swivelled in relation to the base body 1. For this purpose, the swivel body 2 is held or mounted on the swivel shaft sleeve 10 for a swivel movement. At the same time, in this exemplary embodiment, the swivel shaft sleeve 10 serves as a guide for the translationally movable slide piston 5*a* and/or as a component cooperating telescopically with the slide piston 5*a*. In the exemplary embodiment shown, the swivel shaft sleeve 10 is formed on a swivel axis component 22 which, in addition, has a fastening flange 23 which protrudes radially at the one end of the swivel shaft sleeve 10 and on which two holding bolt stubs 24 are arranged protruding laterally and spaced apart from each other, as is apparent in particular from FIG. 8. With the holding bolt stubs 24, the swivel axis component 22 can be fitted into corresponding recesses 25 of a transverse carrier 26 of the base body 1 and can thereby be held on the frame of the base body 1.

In the exemplary embodiment shown, the swivel drive 5 also comprises a transmission element for transmitting the translational movement of the slide piston 5*a* into the swivelling movement of the swivel body 2, wherein the transmission element is realized in the form of a slotted guide mechanism 5*b*. In an advantageous embodiment which is shown, the slotted guide mechanism 5*b* comprises a first guiding part 11 which includes a sliding track 11*a*, and a second guiding part 12 having a sliding cam 12*a* cooperating with the sliding track 11*a*. Of the two guiding parts 11, 12, the one guiding part is arranged unmoved on the base body 1, while the other guiding part is arranged for translational movement together with the translational movement of the slide piston 5*a* and coupled for rotary movement to the swivel body 2. For example, as shown, the first guiding part 11 with the sliding track 11*a* can be arranged in a stationary manner on the base body 1, while the second guiding part 12 with the sliding cam 12*a* is movable in a translational manner with the translational movement of the slide piston 5*a* and coupled for rotary movement to the swivel body 2.

In an exemplary realization, the second guiding part 12 comprises a follower sleeve 12' cooperating with an end face of the slide piston 5*a*. In the example shown, the guiding part 11 containing the sliding track 11*a* is advantageously formed by the swivel shaft sleeve 10; in alternative embodiments of the invention, the guiding part 11 forms a preferably sleeve-shaped component which is different from the swivel shaft sleeve 10 and is formed on the base body 1 or attached unmoved to the latter. In the example shown, the sliding track 11*a* is introduced, as is apparent in particular from FIG. 8, into the sleeve-shaped guiding part 11 in the form of a curved track with a combined axial direction and circumferential direction component. The sliding cam 12*a* projects radially inwards from the follower sleeve 12' and engages in the sliding track 11*a*. This is apparent from FIG. 7 in which, for this purpose, part of the surrounding components is shown cut out in the manner of a window.

The follower sleeve 12' axially adjoins the open end of the slide piston 5*a* and has a diameter of approximately the same size. As a result, when the slide piston 5*a* is displaced from its first piston end position K1 in the direction of its second piston end position K2 because of the fluid pressure of the supplied shower fluid, the follower sleeve 12' is moved axially at the same time by the slide piston 5*a*. By means of the sliding cam 12*a* cooperating with the sliding track 11*a*, which remains stationary, the axial movement of the follower sleeve 12' results in a simultaneous rotation of the follower sleeve 12'. This in turn brings about the desired swivelling of the swivel body 2 because of the rotary coupling of the swivel body 2 to the follower sleeve 12'.

In the exemplary embodiment shown, the rotary coupling of the swivel body 2 to the follower sleeve 12' is realized in the form of a connection for conjoint rotation, for which purpose the follower sleeve 12' has one or more axially running follower webs 12*b* which protrude radially from the outer side of said follower sleeve and each engage in an associated axial groove 13*a*, which axial groove/axial grooves is/are formed on the inner side of a swivel body sleeve 13 which is formed integrally on the swivel body 2 or as a separate component is connected non-rotatably to the swivel body 2. Rotation of the follower sleeve 12' therefore results in corresponding rotation of the swivel body sleeve 13 and therefore of the entire swivel body 2. In alternative embodiments of the invention, the swivel body can be coupled for rotary movement to the follower sleeve via a conventional gearing, with a desired step-up or step-down, depending on requirements.

The swivel body sleeve 13 serves together with the swivel shaft sleeve 10 as a swivel mounting for the swivel body 2 on the base body 1, said swivel shaft sleeve 10 acting for this purpose as a hub. To this end, the swivel body sleeve 13 is placed onto the swivel shaft sleeve 10 for rotary movement. The follower sleeve 12' is accommodated in an annular space 14 remaining between the swivel shaft sleeve 10 and the swivel body sleeve 13. In addition, upon pressurization with fluid pressure, the sleeve-shape slide piston 5*a* can move with its open side into said annular space 14, said slide piston pushing the follower sleeve 12' in front of it in the process.

In an advantageous embodiment, the swivel shower comprises an elastic piston return element 15 preloading the slide piston 5*a* to its first end position K1 and being formed in the example shown by a helical compression spring 15*a*. In alternative embodiments, the elastic piston return element 15 can be formed as a tension spring or as a rubber-elastic element. In the exemplary embodiment shown, the helical compression spring 15*a* is accommodated in the annular gap 14, said helical compression spring being supported on an annular shoulder of the swivel shaft sleeve 10 on the one hand and on the follower sleeve 12' on the other hand. The helical compression spring 15*a* thereby presses the follower element 12' and, with the latter, the slide piston 5*a* in the direction of the first piston end position K1 which corresponds to the rest position Rp of the swivel body 2.

Outside the annular gap 14, axially after the swivel mounting of the swivel body 2, the slide piston 5*a* is guided fluid tightly with the swivel shaft sleeve 10 and the swivel body sleeve 13 in a piston-receiving cylinder 16. The piston-receiving cylinder 16 is part of the base body 1, which is stationary in relation to the swivel body 2, and defines or surrounds the piston chamber 8.

In the exemplary embodiment shown, the swivel body 2 and the base body 1 are formed substantially symmetrically to a centre plane ME of the swivel shower, as shown. This means that the swivel shower which is shown comprises, inter alia, two swivel mountings with a respective swivel shaft sleeve 10 and swivel body sleeve 13 and two swivel drives 5 with a respective slide piston 5*a* and slotted guide mechanism 5*b* of the explained type in a correspondingly mirror-symmetrical arrangement or arrangement symmetrical with respect to the centre plane ME.

A fluid-guiding component 17, part of which belongs to the unmoved base body 1 and another part of which, which is rotatable in relation to the first part, belongs to the swivel body 2 which can be swivelled is located between the two slide pistons 5*a* and the piston-receiving cylinders 16. The fluid-guiding component 17 likewise has a construction which is substantially symmetrical with respect to the centre plane ME and comprises a respective shut-off valve 18 on each side in a portion of a fluid flow path which is formed between the shower fluid inlet 4 or the tubular connection piece 4*a* and the shower outlet 3 or a customary fluid outlet chamber provided upstream of the shower outlet 3 in the shower cartridge 2*a*. The two synchronously operating shut-off valves 18 block the fluid flow path or unblock same as a function of a swivel position of the swivel body 2, wherein they completely block the fluid flow path in the rest position Rp of the swivel body 2 and completely unblock same in the operating position Bp of the swivel body 2.

In the example shown, the two shut-off valves 18 are located in a respective connecting passage 19 from the tubular connection piece 4*a* to a connection stub 20, with which the relevant part of the fluid-guiding component 17 is rigidly connected to the swivel body 2, and each comprise a valve ball 18*a* as valve-closing body, and a valve control contour 18*b* on an outer circumference of a corresponding valve control sleeve. The respective valve control sleeve and consequently the valve control contour 18*b* thereof pivot together with the swivel body 2.

The valve control contour 18*b* is formed in such a manner that it lies opposite the valve ball 18*a* with a blocking contour when the swivel body 2 is in the rest position Rp while it lies opposite the valve ball 18*a* with an unblocking contour if the swivel body 2 is in the operating position Bp. The blocking contour is formed in a conventional manner such that the relevant fluid flow passage is completely blocked when the valve ball 18*a* interacts with the blocking contour. The unblocking contour is formed in such a manner that the relevant fluid passage is unblocked, i.e. is not completely blocked, i.e. fluid can flow past the valve ball 18*a* and the valve control contour 18*b*, when the valve ball 18*a* interacts with the unblocking contour. Such shut-off and unblocking contours are known per se to a person skilled in the art and therefore do not require any more detailed explanation here. Depending on the circumferential angle over which the blocking contour and the unblocking contour extend, the shut-off valve 18 blocks or unblocks the fluid flow path over a corresponding swivel angle of the swivel body 2.

In an advantageous optional variant embodiment, the respective shut-off valve 18 has a switching hysteresis, according to which the valve starts unblocking the fluid flow path during swivelling of the swivel body 2 from its rest position Rp in the direction of the operating position Bp with a delay as compared to it completely blocking the fluid flow path during swivelling of the swivel body 2 from the operating position Bp in the direction of the rest position Rp. As a result, when the swivel body 2 is swivelled back into its rest position Rp, shower fluid can still emerge from the shower outlet 3 for somewhat longer before the shut-off valve 18 then completely blocks the shower fluid supply to the shower outlet 3 as soon as the swivel body 2 has reached a certain shut-off angular position in or before its rest position Rp. By contrast, when the swivel body 2 is swivelled out of its rest position Rp, shower fluid only emerges from the shower outlet 3 when the swivel body 2 has reached an unblocking angular position which is further away from the rest position Rp, by a differential angle corresponding to the switching hysteresis, than the shut-off angular position. As a result, when the swivel body 2 is swivelled back into its rest position Rp, shower fluid which is pushed back out of the respective piston chamber 8 via the connecting passage 9, can still emerge for correspondingly longer from the swivel shower, which avoids corresponding fluid pressure loadings in the shower.

For the respective shut-off valve, use can in particular also be made of such a shut-off valve as disclosed in a parallel German patent application of the applicant (our reference P 56392 DE), the content of which is fully incorporated for this purpose into the present application by reference.

In an advantageous optional variant embodiment, the swivel shower comprises a locking element 21 by means of which the swivel body 2 can be locked in its operating position Bp and can thereby be secured irrespective of the prevailing fluid pressure. The locking element 21 can be, for example, a conventional locking pin which can be moved from an inactive position into a locking position when the swivel body 2 is in the operating position Bp. In the locking position, the locking pin is supported on the base body 1 on the one hand and on the swivel body 2 on the other hand and thereby secures the swivel body 2 in this operating position Bp. By release of the locking element 21, the swivelling of the swivel body 2 back out of its operating position Bp can be unblocked again. Such a locking of the swivel body 2 is useable, for example, for maintenance and repair work. For example, when required, with the shower switched off the jet outlet nozzles 7 can be cleaned in this operating position Bp of the swivel body 2, in which position the jet outlet nozzles 7 are readily accessible.

From the above explanations regarding the construction of the swivel shower, the advantageous manner of operation thereof also becomes clear. In the inactive operating state, fluid is not supplied to the swivel shower. The swivel shower is in the virtually fluid-pressure-free state, in which the respective slide piston 5*a* takes up its first end position K1 and is held preloaded in this position by means of the elastic piston return element 15. The swivel body 2 is correspondingly in its rest position Rp. If, by activation of the fluid supply, the user activates the shower, for example by opening a customary fluid supply shut-off valve, which is not shown here and is connected upstream of the swivel shower, fluid passes via the inlet 4 into the tubular connection piece 4*a* and from there firstly to the respective shut-off valve 18 and secondly into the respective piston chamber 8. The shut-off valve 18 is still in its shut-off position, and therefore fluid still does not emerge from the shower.

By means of the fluid pressure building up in the piston chamber 8, the respective slide piston 5*a* is advanced counter to the preloading force of the elastic piston return element 15, as a result of which said slide piston pushes the follower sleeve 12' in front. In the process, the follower sleeve 12' is rotated at the same time because of the slotted guide mechanism 5*b*, which, in turn, correspondingly rotates or pivots the swivel body 2 out of its rest position Rp. As soon as the swivel body 2 has reached its unblocking angular position, the respective shut-off valve 18 opens the further fluid flow path into the swivel body 2 or to the shower outlet 3 thereof, whereupon the shower fluid emerges as desired from the shower outlet 3 in the form of a shower jet. If the unblocking angular position of the swivel body 2 does not yet correspond to its fully swivelled-out operating position Bp, the swivel body 2 swivels completely into the operating position Bp since the fluid pressure in the piston chamber 8 pushes the respective slide piston 5*a* forwards until it reaches its corresponding end position K2.

At the end of the operation of the shower, the user switches off the fluid supply to the swivel shower. As a result, the fluid pressure in the respective piston chamber 8 drops, and the elastic return element 15 pushes the follower sleeve 12' and with the latter the respective slide piston 5*a* back axially. In the process, the follower sleeve 12' simultaneously rotates back again because of the slotted guide mechanism 5*b*, as a result of which the swivel body 2 correspondingly swivels back. The respective shut-off valve 18 remains entirely or at least partially open until the swivelling-back swivel body 2 has reached its blocking angular position. Up until then, fluid which is pushed back out of the two piston chambers 8 into the tubular connection piece 4*a* by means of the return movement of the slide pistons 5*a* can pass via the two shut-off valves 18 to the shower outlet 3 and out of the shower. After the blocking angular position is reached, the shut-off valves 18 block the fluid flow path to the shower outlet 3 such that no more shower fluid emerges therefrom. If the swivel body 2 is still not yet in its rest position Rp, it subsequently swivels completely back into the rest position Rp by the slide pistons 5*a* being pushed back into their associated end position K1 by the elastic return elements 15 and in the process the follower sleeves 12' correspondingly moving back axially and at the same time being rotated by means of the slotted guide mechanisms 5*b*.

As what has been explained above and shown and the above-explained further exemplary embodiments make clear, the invention provides a swivel shower having highly advantageous properties and a relatively simple construction. The swivel shower is useable in particular in the sanitary region and here especially as a wall- or ceiling-mounted side shower or over-head shower. It goes without saying, however, that the swivel shower is useable beneficially in the same manner for non-sanitary uses wherever there is a need for a shower with a shower outlet which can be swivelled.

The invention claimed is:

1. A swivel shower, comprising a base body;

a swivel body including a shower outlet and held on the base body for swivel movement about a swivel axis between a first swivel body end position, defining a rest position, and a second swivel body end position, defining an operating position;

a shower fluid inlet for supplying a shower fluid; and a swivel drive for driven swiveling of the swivel body, wherein the swivel drive includes a slide piston capable of being pressurized by a fluid pressure of the supplied shower fluid, the slide piston is arranged for translational movement between a first piston end position, corresponding with the first swivel body end position, and a second piston end position, corresponding with the second swivel body end position;

wherein the slide piston is arranged with a translation directional component in parallel to the swivel axis.

2. The swivel shower according to claim 1, wherein the slide piston is at least one of:

guided for translational movement on a swivel shaft sleeve defining the swivel axis; or telescopically shiftable onto or into the swivel shaft sleeve.

3. The swivel shower according to claim 1, further comprising an elastic piston return element preloading the slide piston to the first piston end position.

4. The swivel shower according to claim 1, wherein the swivel body is a cuboid-shaped shower cartridge including the shower outlet on one of its cuboid sides and a cover surface on an adjacent cuboid side, the cover surface is parallel to the visible face of the swivel shower in the first swivel body end position.

5. The swivel shower according to claim 1, further comprising a locking element operably coupled to the swivel body to lock the swivel body in the second swivel body end position.

6. The swivel shower according to claim 1, wherein the shower outlet includes a jet outlet plate having at least one jet outlet nozzle, wherein its nozzle longitudinal axis encloses an acute angle with the jet outlet plate.

7. The swivel shower according to claim 1, further comprising a shut-off valve arranged in a fluid flow path between the shower fluid inlet and the shower outlet, the shut-off valve blocking and unblocking the fluid flow path as a function of a swivel position of the swivel body, wherein the fluid flow path is completely blocked in the first swivel body end position and is completely unblocked in the second swivel body end position.

8. The swivel shower according to claim 1, wherein the swivel shower is a sanitary swivel shower configured for being mounted to a wall or ceiling.

9. The swivel shower according to claim 1, wherein the shower outlet in the rest position of the swivel body is swiveled away from a visible face of the swivel shower, and a swivel angle stroke form the first to the second swivel body end position is at most 90°.

10. A swivel shower, comprising a base body;

a swivel body including a shower outlet and held on the base body for swivel movement about a swivel axis between a first swivel body end position, defining a rest position, and a second swivel body end position, defining an operating position;

a shower fluid inlet for supplying a shower fluid; and a swivel drive for driven swiveling of the swivel body, wherein the swivel drive includes a slide piston capable of being pressurized by a fluid pressure of the supplied shower fluid, the slide piston is arranged for translational movement between a first piston end position, corresponding with the first swivel body end position, and a second piston end position, corresponding with the second swivel body end position;

wherein the swivel drive includes a transmission element in the form of a slotted guide mechanism between the slide piston and the swivel body, and wherein the transmission element transmits the translational movement of the slide piston into a swivel movement of the swivel body.

11. The swivel shower according to claim 10, wherein the slotted guide mechanism comprises a first guiding part including a sliding track, and a second guiding part having a sliding cam cooperating with the sliding track, wherein of the two guiding parts the one guiding part is arranged unmoved on the base body and the other guiding part is arranged for translational movement together with the translational movement of the slide piston and coupled for rotary movement to the swivel body.

12. The swivel shower according to claim 11, wherein the other guiding part includes a follower sleeve cooperating with an end face of the slide piston.

13. The swivel shower according to claim 10, wherein the slide piston is at least one of:

guided for translational movement on a swivel shaft sleeve defining the swivel axis; or telescopically shiftable onto or into the swivel shaft sleeve.

14. The swivel shower according to claim 10, further comprising an elastic piston return element preloading the slide piston to the first piston end position.

15. The swivel shower according to claim 10, wherein the swivel body is a cuboid-shaped shower cartridge including the shower outlet on one of its cuboid sides and a cover surface on an adjacent cuboid side, which cover surface is parallel to the visible face of the swivel shower in the first swivel body end position.

16. The swivel shower according to claim 10, further comprising a locking element operably coupled to the swivel body to lock the swivel body in the second swivel body end position.

17. The swivel shower according to claim 10, wherein the shower outlet includes a jet outlet plate having at least one jet outlet nozzle, wherein its nozzle longitudinal axis encloses an acute angle with the jet outlet plate.

18. The swivel shower according to claim 10, further comprising a shut-off valve arranged in a fluid flow path between the shower fluid inlet and the shower outlet, the shut-off valve blocking and unblocking the fluid flow path as a function of a swivel position of the swivel body, wherein the fluid flow path is completely blocked in the first swivel body end position and is completely unblocked in the second swivel body end position.

19. The swivel shower according to claim 18, wherein the shut-off valve has a switching hysteresis, according to which the valve starts unblocking the fluid flow path during swiveling of the swivel body from the first swivel body end position in the direction towards the second swivel body end position with a delay as compared to it completely blocking the fluid flow path during swiveling of the swivel body from the second swivel body end position in the direction towards the first swivel body end position.

20. The swivel shower according to claim 10, wherein the swivel shower is a sanitary swivel shower configured for being mounted to a wall or ceiling.

* * * * *